US005425501A

United States Patent [19]

Wesorick

[11] Patent Number: 5,425,501

[45] Date of Patent: Jun. 20, 1995

[54] SLIDING HOODED MAIL CARRIER TRAY FOR A MAILBOX

[76] Inventor: Michael J. Wesorick, 2082 Jasper Dairy Rd., Saint Joseph, Mich. 49085

[21] Appl. No.: 133,732

[22] Filed: Oct. 7, 1993

[51] Int. Cl.[6] ..... B65D 91/00

[52] U.S. Cl. ..... 232/17; 232/33

[58] Field of Search ..... 232/17, 27, 29, 30, 232/33; 312/333, 334.18, 334.19, 334.21, 334.47

[56] References Cited

U.S. PATENT DOCUMENTS

| | | | |
|---|---|---|---|
| 1,992,640 | 2/1935 | Stem | 232/17 |
| 2,898,159 | 8/1959 | Armit | 312/334.19 |
| 3,163,356 | 12/1964 | Toehnk | 232/17 |
| 4,121,758 | 10/1978 | Bonner . | |
| 4,244,512 | 1/1981 | Wise | 232/17 |
| 4,600,143 | 7/1986 | Harlow, Jr. et al. . | |
| 4,714,192 | 12/1987 | Harlow, Jr. et al. . | |
| 4,753,385 | 6/1988 | Phipps et al. . | |
| 4,863,096 | 9/1989 | Thomas . | |
| 4,896,827 | 1/1990 | Economon . | |
| 5,000,380 | 3/1991 | Barrios | 232/17 |
| 5,009,366 | 4/1991 | van Druff, Jr. et al. . | |
| 5,083,703 | 1/1992 | Blyakharov . | |
| 5,271,555 | 12/1993 | Mayer | 232/17 |

*Primary Examiner*—Flemming Saether
*Attorney, Agent, or Firm*—Charles F. Meroni, Jr.

[57] ABSTRACT

The present invention relates to an improved sliding hooded mail carrier tray for a conventional rural mailbox structure. The rural type mailbox has a rectangular bottom panel, a back panel extending from one end of the rectangular bottom panel, a U-shaped roof portion extending from opposite sides of the bottom panel and a swinging pivotal door at another end. The improvement consists of a transparent hooded mail carrier having a slightly smaller cross sectional configuration compared to a cross-sectional configuration of the mailbox. The hooded mail carrier comprises a rectangular bottom wall, a back wall extending from the back end of the rectangular bottom wall and a U-shaped hood portion extending from opposite sides of the rectangular bottom wall defining an enclosure with the front end of the hooded mail carrier having an opening for receipt of mail. The hooded mail carrier also has upper rails on opposite sides thereof mounted on the outside of the U-shaped hood portion and lower rollers positioned on a rear portion of the hooded mail carrier beneath the upper rails. The upper rails of the hooded mail carrier are cooperable with upper mailbox rollers attachable at opposite sides of an inside wall of the mailbox and the lower rollers of the hooded mail carrier are cooperable with lower mailbox rails attachable at opposite sides of an inside wall of the mailbox in order for the hooded mail carrier to slide smoothly in horizontal telescoping engagement in and out of the mailbox. A stop lever is mounted on an inside wall of the mailbox for coaction with the upper rails to ensure that the hooded mail carrier does not come all the way out from the mailbox wherein any mail can be easily inserted and retrieved protecting the mail from weather elements when the hooded mail carrier is extended from the mailbox. When the hooded mail carrier is fully inserted into the mailbox, then the mailbox can be closed with the hooded mail carrier enclosed within the mailbox.

17 Claims, 4 Drawing Sheets

SLIDING HOODED MAIL CARRIER TRAY FOR A MAILBOX

BACKGROUND OF THE INVENTION

The present invention relates in general to a conventional rural type mailbox used on rural mail delivery routes, and more particularly to a rural type mailbox having sliding hooded tray inserts therein utilized to assist in the depositing and gathering of mail as well as protecting the mail from damage from adverse weather conditions.

There have been several different methods directed to inserting and removing mail from rural type mailboxes. Such rural mailboxes are generally mounted on wooden posts or poles alongside a road so as to be easily accessible for the post office to deliver mail. Unfortunately, it is not always convenient for delivery persons or homeowners to gain access to the rural type mailbox. It is often difficult for a person in a vehicle to position their window close enough to the mailbox in order to reach the mail that is in the mailbox and it is often impossible to even see and/or reach any mail that is located in the rear portion of the mailbox.

Because of the problems of inserting and retrieving mail in rural type mailboxes, there have been many different types of mailbox inserts that deal with the retrieval of mail, for example, U.S. Pat. Nos. 4,600,143 and 4,714,192 to Harlow et al, 4,753,385 to Phipps et al., 4,896,827 to Economon, 5,009,366 to van Druff, Jr. et al, and 5,083,703 to Blyakharov among others. These mailbox inserts do not protect the mail from adverse weather conditions such as harsh winds that can blow the mail out of the tray or rain that can cause the mail to get inconveniently wet while the mail is being inserted or retrieved. These mailbox inserts can also cause problems after extensive use and can no longer easily slide in and out of the mailbox.

The object of the present invention is to provide a mail tray insert that will provide long term easy retrieval and insertion of mail as well as protecting the mail as it is being retrieved from adverse weather conditions such as rain, wind, snow, slush and the like. My mail tray insert is hooded and is made of a transparent synthetic plastic material. Therefore the mail is protected from the top as well as the sides while being retrieved. Also, one can also easily look through the transparent hooded mail carrier and see if all of the mail has been retrieved instead of searching the mail tray by sense of feel. My sliding hooded mail carrier tray is also equipped with rails and rollers that make it easy for the hooded mail tray to slide in an out horizontally without the tray tipping or causing any undue friction on the mailbox or the mail carrier tray, therefore providing a mail carrier tray with a long life.

SUMMARY OF THE INVENTION

In accordance with my invention I have provided a conventional rural mailbox structure including a mailbox having a rectangular bottom panel, a back panel extending from one end of the rectangular bottom panel, a U-shaped roof portion extending from opposite sides of the bottom panel and a swinging pivotal door at another end, the improvement consisting of a hooded mail carrier having a slightly smaller cross-sectional configuration compared to a cross-sectional configuration of the mailbox, the hooded mail carrier comprising a rectangular bottom wall, a back wall extending from the back end of the rectangular bottom wall and a U-shaped hood portion extending from opposite sides of the rectangular bottom wall defining an enclosure with the front end of the hooded mail carrier having an opening for receipt of mail, the hooded mail carrier also having upper rails on opposite sides thereof mounted on the outside of the U-shaped hood portion and lower rollers positioned on a rear portion of the hooded mail carrier beneath the upper rails, the upper rails of the hooded mail carrier being cooperable with upper mailbox rollers attachable at opposite sides of an inside wall of the mailbox and the lower rollers of the hooded mail carrier being cooperable with lower mailbox rails attachable at opposite sides of an inside wall of the mailbox in order for the hooded mail carrier to slide smoothly in horizontal telescoping engagement in and out of the mailbox, and a stop lever mountable on an inside wall of the mailbox for coaction with the upper rails to ensure that the hooded mail carrier does not come all the way out from the mailbox wherein any mail can be easily inserted and retrieved protecting the mail from weather elements when the hooded mail carrier is extended from the mailbox, and when the hooded mail carrier is fully inserted into the mailbox then the mailbox can be closed with the hooded mail carrier enclosed within the mailbox.

Other features of my invention provide that the hooded mail carrier is comprised of a transparent synthetic plastic material including a transparent hood section for protecting any mail deposited in the hooded mail carrier from weather elements as the hooded mail carrier is withdrawn from the mailbox and telescoped back into the mailbox.

Further features of my invention provide that the hooded mail carrier has a finger hole located at the front end thereof to be used as a handle for pulling and pushing the hooded mail carrier in and out of the mailbox.

Still other features of my invention provide that the upper rails of the hooded mail carrier and lower rails of the mailbox are of a channel shaped configuration, the upper rails are attached to the hooded mail carrier at opposite sides thereof leaving the channels opening outwardly in a direction away from one another and the lower rails are attached to the mailbox at opposite sides thereof leaving the channels opening inwardly in a direction towards one another, the upper rollers are mounted on an interior surface of the mailbox and the lower rollers are mounted on an exterior surface of the hooded mail carrier, the upper rollers of the mailbox engaging with the upper channel shaped rails of the hooded mail carrier and the lower rollers of the hooded mail carrier engaging with the lower channel shaped rails of the mailbox in sliding horizontal engagement together.

Yet other features of my invention relate to a hooded mail carrier for insertion into a conventional rural mailbox, the hooded mail carrier having a slightly smaller cross-sectional configuration compared to a cross-sectional configuration of the mailbox, the hooded mail carrier comprising a rectangular bottom wall, a back wall extending from the back end of the rectangular bottom wall and a U-shaped hood portion extending from opposite sides of the rectangular bottom wall defining an enclosure with the front end of the hooded mail carrier having an opening for receipt of mail, the hooded mail carrier also having upper rails on opposite sides thereof mounted on the outside of the U-shaped hood portion and lower rollers positioned on a rear portion of the hooded mail carrier beneath the upper rails, the upper rails of the hooded mail carrier being cooperable with upper mailbox rollers attachable at opposite sides of an inside wall of the mailbox and the lower rollers of the hooded mail carrier being cooperable with lower mailbox rails attachable at opposite sides of an inside wall of the mailbox in order for the hooded mail carrier to slide smoothly in horizontal telescoping engagement in and out of the mailbox wherein any mail can be easily inserted and retrieved protecting the mail from weather elements when the hooded mail carrier is extended from the mailbox, and when the hooded mail carrier is fully inserted into the mailbox then the mailbox can be closed with the hooded mail carrier enclosed within the mailbox.

DESCRIPTION OF THE PREFERRED EMBODIMENT

Figure 1:
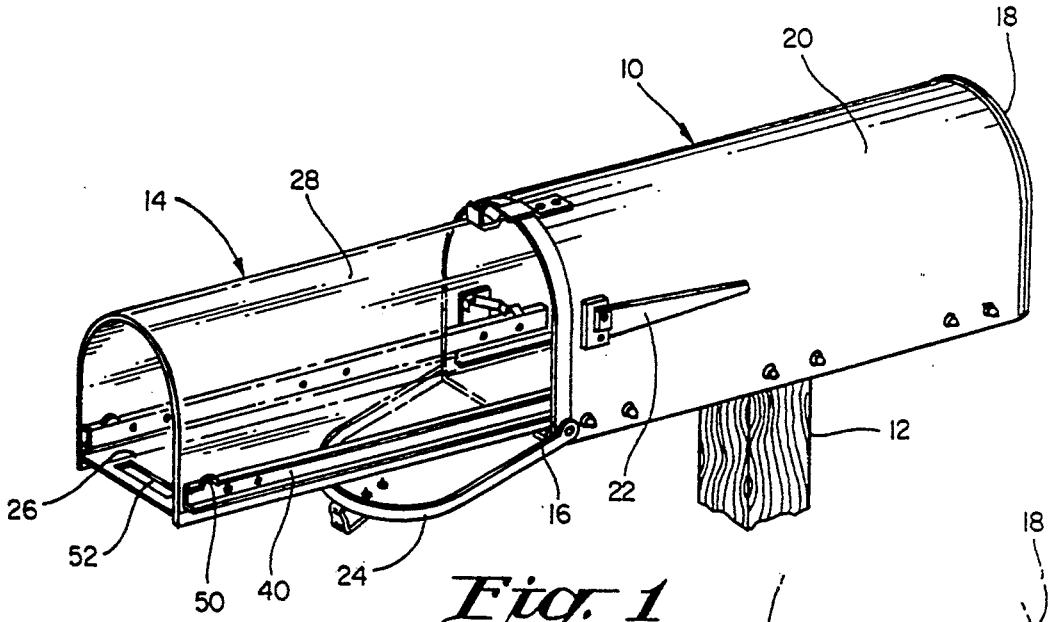
FIG. 1 is a perspective view of a conventional rural mailbox having my transparent sliding hooded mail carrier tray in full extension from the mailbox.

Referring now to the drawings, FIG. 1 illustrates a conventional opaque rural type mailbox 10 mounted on a wooden post 12 secured to the grounds and a sliding hooded mail carrier tray 14 illustrating the present invention.

The rural mailbox 10 has a rectangular bottom panel 16, a back panel 18 extends from a back end of the rectangular bottom panel 16, a U-shaped roof portion 20 extends from opposite sides of the bottom panel defining an enclosure therein, a pivotal flag 22 is attached to the side of the roof portion and a swinging pivotal door 24 is located at a front end thereof. The sliding hooded mail carrier tray 14 has a slightly smaller cross-sectional configuration as compared to a cross-sectional configuration of the rural mailbox 10. The hooded mail carrier 14 comprises a rectangular bottom wall 26, a back wall 27 extends from the back end of the rectangular bottom wall 26 and a U-shaped hood portion 28 extends from opposite sides of the rectangular bottom wall 26 defining an enclosure with the front end of the hooded mail carrier being open for receipt of mail. The hooded mail carrier 14 is made of a transparent synthetic plastic material making it easy to see if any mail is left in the hooded mail carrier 14 and also protecting any mail from adverse weather conditions such as rain, wind, snow, slush and the like. The hooded mail carrier can be made as a one piece molded plastic material or the pieces can be glued together with a transparent epoxy.

Figure 2:
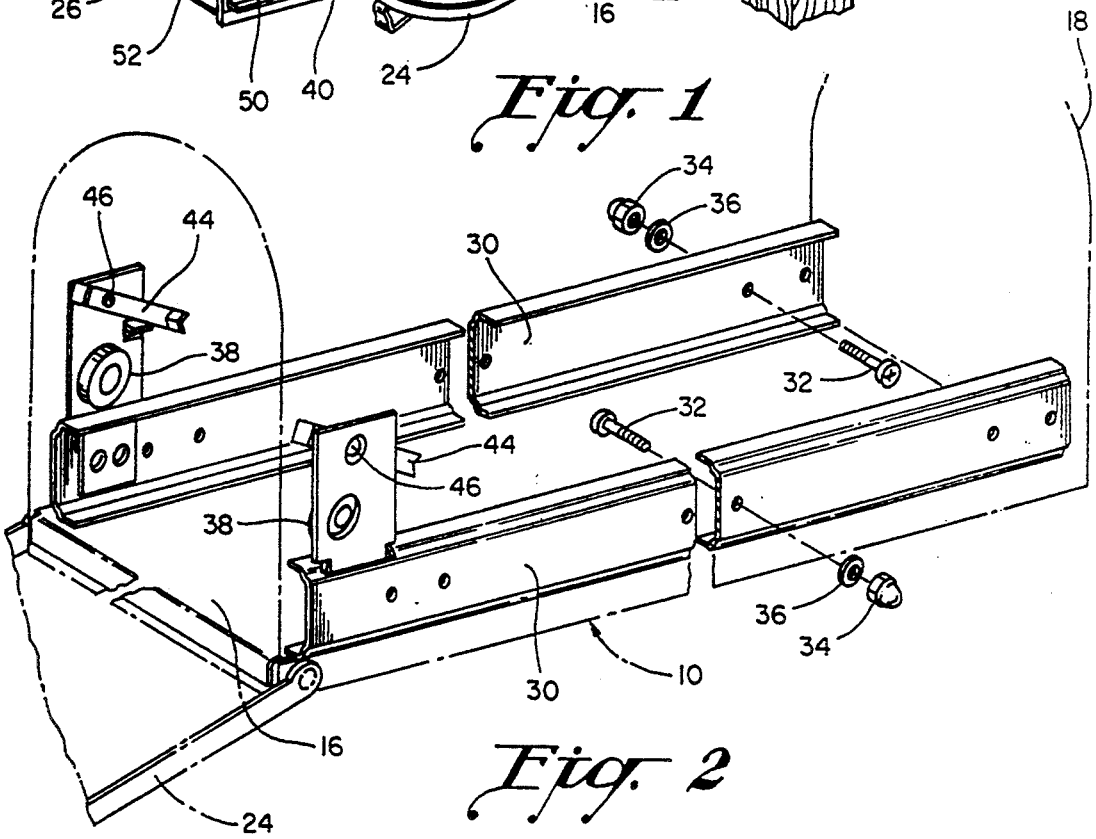
FIG. 2 is a fragmentary perspective view showing the elements located within the conventional rural mailbox.
Figure 6:
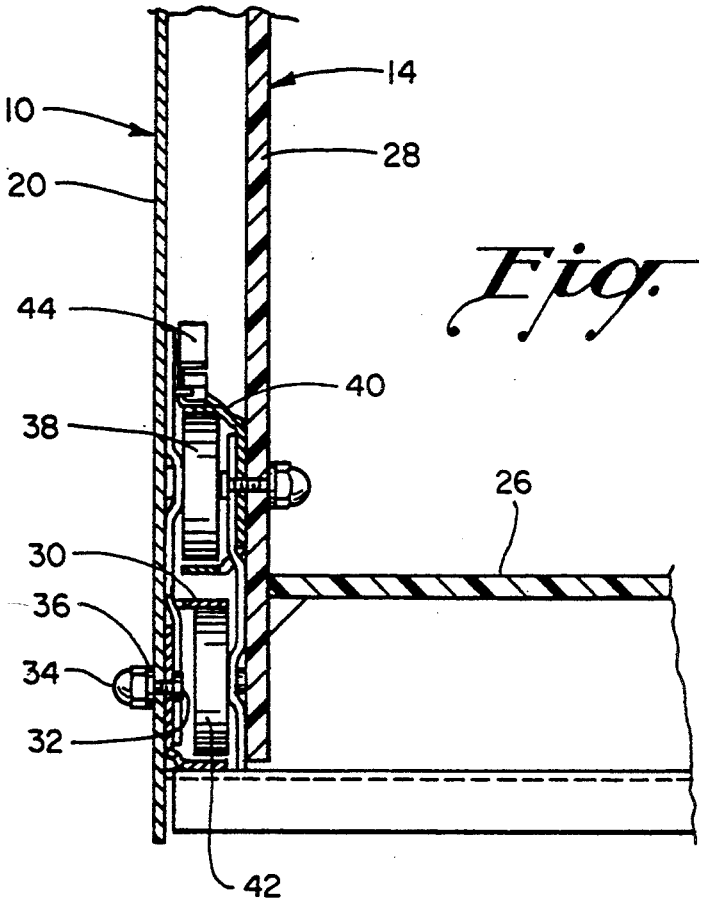
FIG. 6 is a partial cross-sectional front view of the mailbox and my hooded mail carrier showing how the rails and rollers are mounted and engaged with hooded mail carrier and the mailbox.

As seen in FIGS. 2 and 6, the mailbox 10 has lower rails 30 mounted by screws 32, caps 34 and washers 36 on opposite sides on an inside wall of the mailbox 10. The lower rails 30 have a channel shaped configuration for receipt of rollers from the hooded mail carrier 14. Upper rollers 38 are mounted above the lower rails 30 on opposite sides of the mailbox 10 at a location near the opening of the mailbox.

Figure 3:
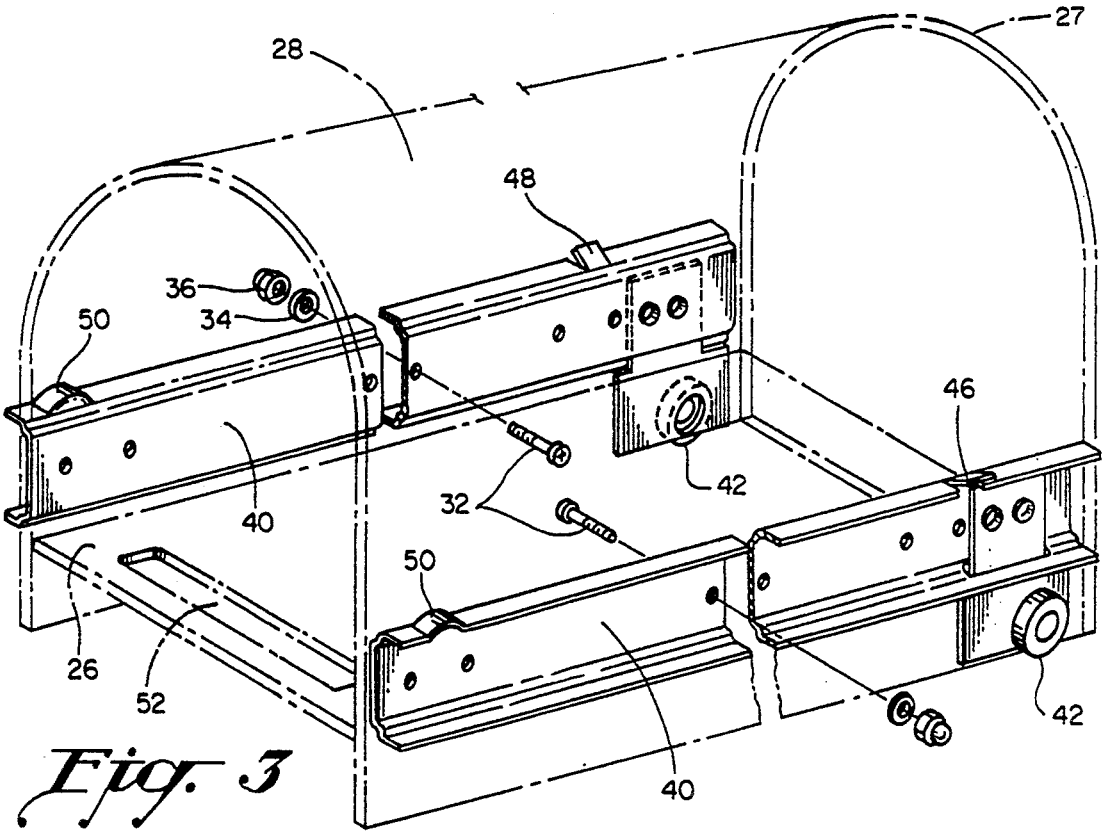
FIG. 3 is a fragmentary perspective view showing my transparent sliding hooded mail carrier tray embodying important features of my invention.

As seen in FIGS. 3 and 6, the hooded mail carrier 14 has upper rails 40 on opposite sides mounted by screws 32, caps 34 and washers 36. The upper rails 40 have a channel shaped configuration for receipt upper rollers 38 from the mailbox 10. Lower rollers 42 are also attached on the rear portion of the hooded mail carrier 14 beneath the upper rails 40. The rails 30, 40 and rollers 38, 42 are positioned such that when the hooded mail carrier 14 is inserted into the mailbox 10, the upper rollers 38 of the mailbox will slide within the upper rails 40 of the hooded mail carrier 14, and the lower rollers 42 of the hooded mail carrier 14 will slide within the lower rails 30 of the mailbox 10, therefore providing a horizontal sliding assembly of the hooded mail carrier within the mailbox. The hooded mail carrier 14 is sized to fully fit within the mailbox 10 and leaving room for the mailbox 10 to be closed with the swinging pivotal door 24. The hooded mail carrier is to slide smoothly in horizontal telescoping engagement of a substantial portion of the hooded mail carrier in and out of the mailbox, as shown in the drawings. As best illustrated in FIG. 1, the front end of the hooded mail carrier is extendible substantially beyond an outer forward most edge of the swinging pivotal door 24 when the swinging pivotal door 24 is in a position essentially coplanar with the rectangular bottom wall 26 of the hooded mail carrier.

Figure 4:
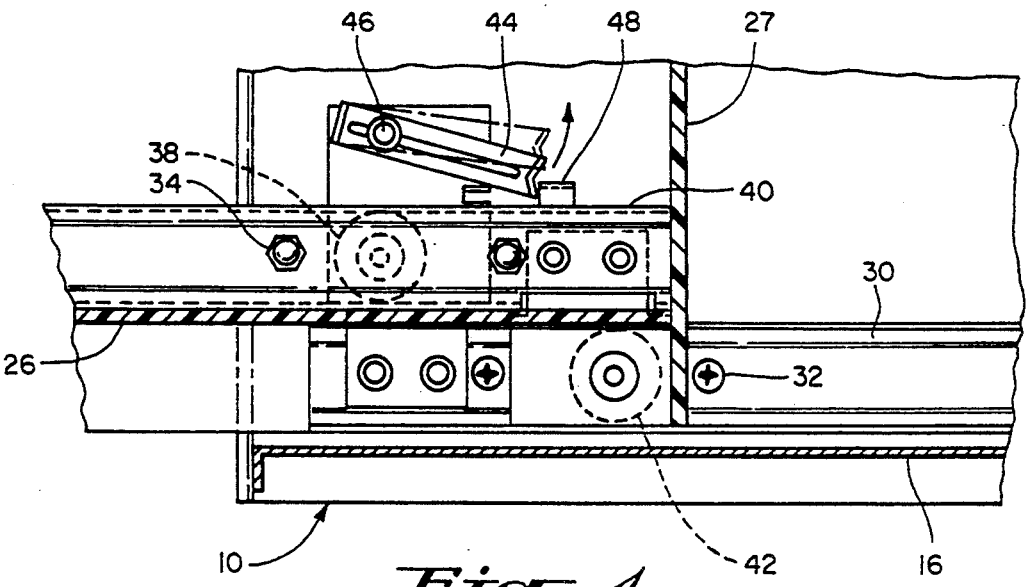
FIG. 4 is a partial cross-sectional side view of the mailbox and my hooded mail carrier with the hooded mail carrier in a fully extended position from the mailbox.

A stop lever 44 is attached by a pin 46 on opposite sides within the mailbox 10 above the upper rollers 38. The stop lever 44 is attached so that it will pivot about the pin 46 and that the back end of the stop lever will always angle down due to gravity when the mailbox is mounted in a level position. A part of the upper rails 40 on the hooded mail carrier 14 is turned up to provide a stop block 48. Therefore, when the hooded mail carrier 14 is pulled from the mailbox 10, the stop lever 44 will engage with the stop block 48 and will inhibit the hooded mail carrier 14 from being pulled all the way from the mailbox 10 as seen in FIG. 4. The hooded mail carrier 14 can then only be removed if each of the stop levers 44 are pushed up to disengage the stop lever 44 from the stop block 48.

Figure 5:
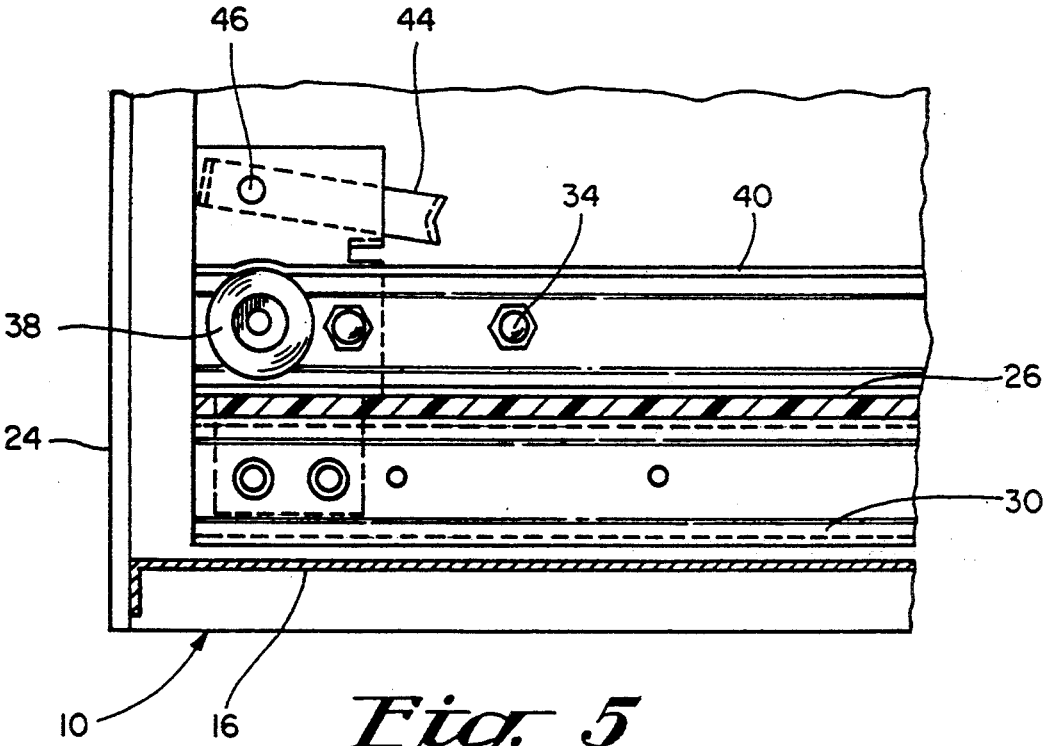
FIG. 5 is a partial cross-sectional side view of the mailbox and my hooded mail carrier with the hooded mail carrier fully inserted within the mailbox.

The upper rails 40 of the hooded mail carrier 14 also have a curved up section 50 so that when the hooded mail carrier 14 is inserted all the way into the mailbox 10, the curved up section 50 will rest on the upper roller 38 of the mailbox as seen in FIG. 5. Therefore, the hooded mail carrier 14 will not accidentally roll out of the mailbox 10 when the mailbox is in an open position. The curved up section 50 is curved enough so that if the mailbox 10 was left open and was either positioned in a tilted position or was somehow pushed, then the hooded mail carrier 14 would not roll out of the mailbox but can be easily pulled out by a user.

The hooded mail carrier 14 also has a finger hole 52 located at a front end of the bottom wall 26 to be used as a handle for pulling and pushing the hooded mail carrier 14 in and out of the mailbox 10.

Figure 7:
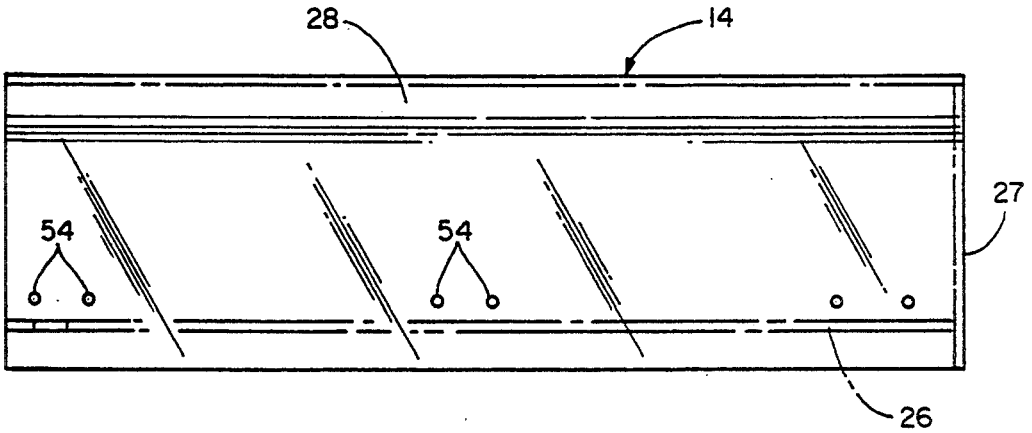
FIG. 7 is a side view illustrating my transparent hooded mail carrier without the rails and rollers attached.
Figure 8:
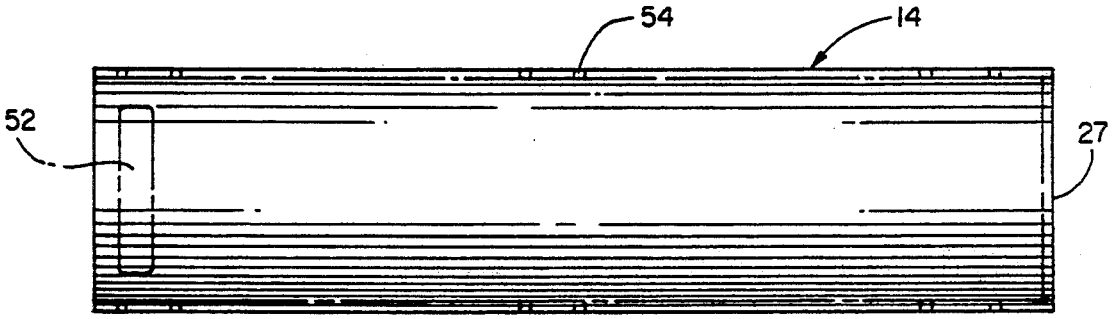
FIG. 8 is a top plan view illustrating my transparent hooded mail carrier without the rails and rollers attached.

FIGS. 7 and 8 illustrate side and top plan views of my hooded mail carrier 14 without the rails and rollers attached showing holes 54 for receipt of screws to mount the rails and rollers.

Figure 9:
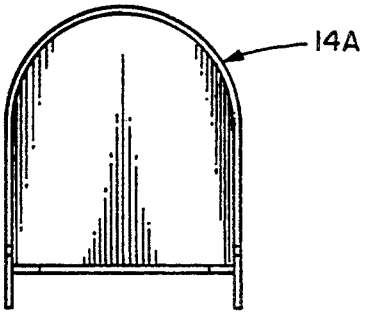
FIG. 9 is a front view illustrating my modified molded one-piece hooded mail carrier without the rails and rollers attached.

FIG. 9 depicts a hooded mail carrier 14A as a molded one-piece unit. The hooded mail carrier 14A being of the same size and configuration as the hooded mail carrier 14.

As various possible embodiments may be made in the above invention for use for different purposes and as various changes might be made in the embodiments and method above set fort, it is understood that all of the above matters here set forth or shown in the accompanying drawings are to be interpreted as illustrative and not in a limiting sense.

I claim:

1. In a conventional rural mailbox structure including an opaque mailbox having a rectangular bottom panel, a back panel extending from one end of the rectangular bottom panel, a U-shaped roof portion extending from opposite sides of the bottom panel and a swinging pivotal door at another end, the improvement of a hooded mail carrier comprised of a transparent material having a slightly smaller cross-sectional configuration compared to a cross-sectional configuration of the mailbox, the hooded mail carrier comprising a rectangular bottom wall, a back wall extending from the back end of the rectangular bottom wall and a U-shaped hood portion extending from opposite sides of the rectangular bottom wall defining an enclosure with a front end of the hooded mail carrier having an opening for receipt of mail, the hooded mail carrier also having upper rails on opposite sides thereof mounted on the outside of the U-shaped hood portion and lower rollers positioned on a rear portion of the hooded mail carrier beneath said upper rails, said upper rails of the hooded mail carrier being cooperable with upper mailbox rollers attachable at opposite sides of an inside wall of the mailbox and said lower rollers of the hooded mail carrier being cooperable with lower mailbox rails attachable at opposite sides of an inside wall of the mailbox in order for the hooded mail carrier to slide smoothly in horizontal telescoping engagement of a substantial portion of the hooded mail carrier in and out of the mailbox, the front end of the hooded mail carrier being extendible substantially beyond an outer forward most edge of the swinging pivotal door when the swinging pivotal door is in a position essentially coplanar with the rectangular bottom wall of the hooded mail carrier, and a stop means mountable on an inside wall of the mailbox for coaction with the upper rails to ensure that the hooded mail carrier does not come all the way out from the mailbox wherein any mail can be easily inserted and retrieved protecting the mail from weather elements when the hooded mail carrier is extended from the mailbox, and when the hooded mail carrier is fully inserted into the mailbox then the mailbox can be closed with the hooded mail carrier enclosed within the mailbox.

2. The mailbox structure of claim 1 wherein the hooded mail carrier is comprised of a one-piece molded transparent synthetic plastic material including a transparent hood section for protecting any mail deposited in the hooded mail carrier from weather elements as the hooded mail carrier is withdrawn from the mailbox and telescoped back into the mailbox.

3. The mailbox structure of claim 1 wherein the rectangular bottom wall of the hooded mail carrier has a finger hole located at the front end thereof to be used as a handle for pulling and pushing the hooded mail carrier in and out of the mailbox.

4. The mailbox structure of claim 1 wherein said upper rails of the hooded mail carrier and lower rails of the mailbox being of a channel shaped configuration, attachment means attaching the upper rails to the hooded mail carrier at opposite sides thereof leaving the channels opening outwardly in a direction away from one another and attachment means attaching the lower rails to the mailbox at opposite sides thereof leaving the channels opening inwardly in a direction towards one another, said upper rollers being mounted on an interior surface of the mailbox and said lower rollers being mounted on an exterior surface of the hooded mail carrier, the upper rollers of the mailbox being engageable with the upper channel shaped rails of the hooded mail carrier and the lower rollers of the hooded mail carrier being engageable with the lower channel shaped rails of the mailbox in sliding horizontal engagement together.

5. The mailbox structure of claim 1 wherein the upper rails of the hooded mail carrier have a turned up section at a top rear end of the upper rails, said stop means comprising a pivotally mounted stop member which when in a downwardly angled attitude the stop member is adapted to engage with the turned up section to inhibit the hooded mail carrier from being withdrawn from the mailbox.

6. The mailbox structure of claim 1 wherein said stop member is pivotally mounted on the inside of the mailbox and being movable from a stopping position to a disengaged position thus enabling the hooded mail carrier to be removed from the mailbox when the stop member is moved to its disengaged position.

7. The mailbox structure of claim 1 wherein the upper rails of the hooded mail carrier have a curved up section at a top front end of the upper rails, said curved up section being in a position so that when the hooded mail carrier is fully inserted within the mailbox, the curved up section will rest upon the upper rollers of the mailbox keeping the hooded mail carrier from accidentally rolling out of the mailbox, said curved up section being curved enough to inhibit the hooded mail carrier from easily sliding out on its own but being easy for a user to pull the hooded mail carrier from the mailbox.

8. In combination, a conventional rural mailbox structure and a hooded mail carrier, the mailbox being opaque and having a rectangular bottom panel, a back panel extending from one end of the rectangular bottom panel, a U-shaped roof portion extending from opposite sides of the bottom panel and a swinging pivotal door at another end, the hooded mail carrier comprised of a transparent material and having a cross-sectional configuration compared to a slightly smaller cross-sectional configuration of the mailbox, the hooded mail carrier comprising a rectangular bottom wall, a back wall extending from the back end of the rectangular bottom wall and a U-shaped hood portion extending from opposite sides of the rectangular bottom wall defining an enclosure with a front end of the hooded mail carrier having an opening for receipt of mail, the hooded mail carrier also having upper rails on opposite sides thereof mounted on the outside of the U-shaped hood portion and lower rollers positioned on a rear portion of the hooded mail carrier beneath said upper rails, said upper rails of the hooded mail carrier being cooperable with upper mailbox rollers attachable at opposite sides of an inside wall of the mailbox and said lower rollers of the hooded mail carrier being cooperable with lower mailbox rails attachable at opposite sides of an inside wall of the mailbox in order for the hooded mail carrier to slide smoothly in horizontal telescoping engagement of a substantial portion of the hooded mail carrier in and out of the mailbox, the front end of the hooded mail carrier being extendible substantially beyond an outer forward most edge of the swinging pivotal door when the swinging pivotal door is in a position essentially coplanar with the rectangular bottom wall of the hooded mail carrier, and a stop means mountable on an inside wall of the mailbox for coaction with the upper rails to ensure that the hooded mail carrier does not come all the way out from the mailbox wherein any mail can be easily inserted and retrieved protecting the mail from weather elements when the hooded mail carrier is extended from the mailbox, and when the hooded mail carrier is fully inserted into the mailbox then the mailbox can be closed with the hooded mail carrier enclosed within the mailbox.

9. The combination of claim 8 wherein the hooded mail carrier is comprised of a one-piece molded transparent synthetic plastic material including a transparent hood section for protecting any mail deposited in the hooded mail carrier from weather elements as the hooded mail carrier is withdrawn from the mailbox and telescoped back into the mailbox.

10. The combination of claim 8 wherein the rectangular bottom wall of the hooded mail carrier has a finger hole located at the front end thereof to be used as a handle for pulling and pushing the hooded mail carrier in and out of the mailbox.

11. The combination of claim 8 wherein said upper rails of the hooded mail carrier and lower rails of the mailbox being of a channel shaped configuration, attachment means attaching the upper rails to the hooded mail carrier at opposite sides thereof leaving the channels opening outwardly in a direction away from one another and attachment means attaching the lower rails to the mailbox at opposite sides thereof leaving the channels opening inwardly in a direction towards one another, said upper rollers being mounted on an interior surface of the mailbox and said lower rollers being mounted on an exterior surface of the hooded mail carrier, the upper rollers of the mailbox being engageable with the upper channel shaped rails of the hooded mail carrier and the lower rollers of the hooded mail carrier being engageable with the lower channel shaped rails of the mailbox in sliding horizontal engagement together.

12. The combination of claim 8 wherein the upper rails of the hooded mail carrier have a turned up section at a rear end of the rails, said stop means comprising a pivotally mounted stop member which when in a downwardly angled attitude the stop member is adapted to engage with the turned up section to inhibit the hooded mail carrier from being withdrawn from the mailbox.

13. The combination of claim 8 wherein said stop member is pivotally mounted on the inside of the mailbox and being movable from a stopping position to a disengaged position thus enabling the hooded mail carrier to be removed from the mailbox when the stop member is moved to its disengaged position.

14. A hooded mail carrier for insertion into a conventional opaque rural mailbox, the hooded mail carrier comprised of a transparent material and having a slightly smaller cross-sectional configuration compared to a cross-sectional configuration of the mailbox, the hooded mail carrier comprising a rectangular bottom wall, a back wall extending from the back end of the rectangular bottom wall and a U-shaped hood portion extending from opposite sides of the rectangular bottom wall defining an enclosure with a front end of the hooded mail carrier having an opening for receipt of mail, the hooded mail carrier also having upper rails on opposite sides thereof mounted on the outside of the U-shaped hood portion and lower rollers positioned on a rear portion of the hooded mail carrier beneath said upper rails, said upper rails of the hooded mail carrier being cooperable with upper mailbox rollers attachable at opposite sides of an inside wall of the mailbox and said lower rollers of the hooded mail carrier being cooperable with lower mailbox rails attachable at opposite sides of an inside wall of the mailbox in order for the hooded mail carrier to slide smoothly in horizontal telescoping engagement of a substantial portion of the hooded mail carrier in and out of the mailbox wherein any mail can be easily inserted and retrieved protecting the mail from weather elements when the hooded mail carrier is extended from the mailbox, the front end of the hooded mail carrier being extendible substantially beyond an outer forward most edge of a swinging pivotal door of the mailbox when the swinging pivotal door is in a position essentially coplanar with the rectangular bottom wall of the hooded mail carrier, and when the hooded mail carrier is fully inserted into the mailbox then the mailbox can be closed with the hooded mail carrier enclosed within the mailbox.

15. The hooded mail carrier of claim 14 wherein the hooded mail carrier is comprised of a one-piece molded transparent synthetic plastic material including a transparent hood section for protecting any mail deposited in the hooded mail carrier from weather elements as the hooded mail carrier is withdrawn from a conventional rural mailbox and telescoped back into the mailbox.

16. The hooded mail carrier of claim 14 wherein the rectangular bottom wall of the hooded mail carrier has a finger hole located at the front end thereof to be used as a handle for pulling and pushing the hooded mail carrier in and out of a conventional rural mailbox.

17. The hooded mail carrier of claim 14 wherein said upper rails of the hooded mail carrier and lower rails of a conventional rural mailbox being of a channel shaped configuration, attachment means attaching the upper rails to the hooded mail carrier at opposite sides thereof leaving the channels opening outwardly in a direction away from one another and attachment means attaching the lower rails to the mailbox at opposite sides thereof leaving the channels opening inwardly in a direction towards one another, said upper rollers being mounted on an interior surface of the mailbox and said lower rollers being mounted on an exterior surface of the hooded mail carrier, the upper rollers of the mailbox being engageable with the upper channel shaped rails of the hooded mail carrier and the lower rollers of the hooded mail carrier being engageable with the lower channel shaped rails of the mailbox in sliding horizontal engagement together.

* * * * *